United States Patent [19]

Hadaway

[11] Patent Number: 4,611,483

[45] Date of Patent: Sep. 16, 1986

[54] PRESS AND METHOD OF MAKING SAME

[75] Inventor: Bernard M. Hadaway, Highett, Australia

[73] Assignee: REPCO Limited, Australia

[21] Appl. No.: 621,544

[22] Filed: Jun. 18, 1984

[30] Foreign Application Priority Data

Jun. 28, 1983 [AU] Australia ..... PG0024

[51] Int. Cl.[4] ..... B21J 9/18

[52] U.S. Cl. ..... 72/453.02; 72/453.07; 72/453.13; 72/333; 72/338; 72/446; 72/427; 83/137; 83/132; 83/126; 83/639

[58] Field of Search ..... 72/453.01, 453.02, 453.06, 72/453.07, 453.13, 453.14, 333, 337, 338, 339, 456, 446, 427; 83/137, 142, 132, 125, 126, 639

[56] References Cited

U.S. PATENT DOCUMENTS

| | | | |
|---|---|---|---|
| 2,417,697 | 3/1947 | Loomis | 100/214 |
| 2,997,969 | 8/1961 | Holmes, Jr. | 72/456 |
| 3,107,567 | 10/1963 | Linder | 83/137 |
| 3,564,959 | 2/1971 | Harada | 83/137 |
| 3,722,337 | 3/1937 | Brolund | 83/137 |
| 3,739,669 | 6/1973 | Seki | 83/137 |
| 3,848,494 | 11/1974 | Gargrave et al. | 100/918 |
| 4,096,728 | 6/1978 | Glecker et al. | 72/446 |
| 4,214,465 | 7/1980 | Rode | 72/446 |
| 4,382,737 | 5/1983 | Jensen et al. | 72/348 |
| 4,516,448 | 5/1985 | Hill et al. | 83/137 |

FOREIGN PATENT DOCUMENTS

| | | | |
|---|---|---|---|
| 103239 | 8/1980 | Japan | 72/447 |
| 58927 | 4/1982 | Japan | 72/337 |

*Primary Examiner*—Francis S. Husar
*Assistant Examiner*—David B. Jones
*Attorney, Agent, or Firm*—Stevens, Davis, Miller & Mosher

[57] ABSTRACT

A metal working press having a base, a die set located over the base, and coaxial primary and secondary rams movable towards and away from the base to drive the die set through a working stroke and return it to an open condition. The die set includes upper and lower die assemblies and the upper die assembly is connected to the primary ram in such a manner as to prevent axial separation but permit lateral movement of the die set relative to the ram whereby the die set can be moved into and out of the press. The upper die assembly includes two die members which are relatively movable in the axial direction of the ram and the extent of that relative movement is preset by a lost motion mechanism existing in the connection between the primary ram and the upper die assembly and also by engagement between opposed surfaces of the two rams. An adjustable stop fixes the open position of the die set by cooperation with the secondary ram and a locking mechanism is provided to releasably hold the die set in the open position during removal from and replacement in the press. The rams are mounted in a cylinder which is connected to the base through side plates and each side plate has two part-cylindrical surfaces each of which engages with a complementary surface of the base and cylinder respectively, and those part-cylindrical surfaces are formed about a common axis.

32 Claims, 22 Drawing Figures

PRESS AND METHOD OF MAKING SAME

This invention relates to presses as used in any of a variety of metal working processes such as coining, extrusion, compaction and blanking. It will be convenient, however, to hereinafter describe the invention with particular reference to hydraulic fine blanking presses.

A difficulty with presses of the foregoing kind is that replacement of the tools (die set) is a complicated and time consuming operation. The individual dies are usually secured to their respective bolsters or other supports by bolts or studs extending generally in the axial direction of the press. It is therefore necessary to provide access to those bolts or studs. Furthermore, it is usually necessary to rearrange the press after replacement of one die set by another to take care of the different working requirements of the respective die sets.

Parts removal presents another difficulty which is not adequately attended to with conventional presses. It is normal to use compressed air to blow the blanked parts from between the dies, but that is an expensive, noisy and not very reliable system. In view of the lack of reliability, special back-up sensors are often provided to guard against parts not being removed by the blower. Furthermore, such a removal system requires additional means to suitably orient the removed parts if they are to be subjected to finishing or other treatment.

An object of the present invention is to provide a press of the kind indicated in which die set replacement is a relatively simple operation. It is another object to provide an improved method of manufacturing a press of the kind indicated.

According to one aspect of the invention, there is provided a metal working press including, a base, a working ram assembly axially movable towards and away from the base and comprising a primary ram and a secondary ram which are arranged substantially coaxial and are movable axially relative to one another, said primary ram being slidable axially within an axial bore of the secondary ram, a die set located between said base and said ram assembly and being removable from the press to enable replacement by another said die set, said die set including upper and lower die assemblies and means interconnecting those die assemblies so that they are movable towards and away from each other in the axial direction of said ram assembly, said upper die assembly including two die members which are relatively movable in said axial direction and each of which is arranged to be driven towards said base through a working stroke by a respective one of said rams, connecting means including cooperable parts of said primary ram and said upper die assembly which operates to prevent separation of said ram assembly and said die set in said axial direction but allows such separation in a direction transverse to said axial direction so that the die set can be moved into and out of the press in said transverse direction, and means releasably retaining said die set against said transverse separation.

It is preferred that one part of the connecting means has a transverse slot and that slot has a cross-sectional shape such as to provide a shoulder which faces in the aforementioned axial direction. The other part of the connecting means has a projection having a shape substantially complementary to that of the slot cross section and axial separation between the two parts is prevented by engagement between that projection and the shoulder.

It is also preferred that the press is provided with an adjustable stop to limit separation between two parts of the die set, and that stop may comprise a ring nut threadably engaging with a stationary part of the press and arranged for engagement by part of the working ram.

The press may also include a blade which is arranged to sweep across a surface of the die set in one direction so as to remove waste material lodged on that surface, and it is preferred that the blade will also traverse the surface in the reverse direction to remove a blanked part formed by operation of the press and which is exposed at the die part surface after the blade has traversed that surface in the aforementioned one direction.

According to another aspect of the invention there is provided a method of forming a press including the steps of, securing two side plates to a fixture so that broad surfaces of said plates are in spaced opposed relationship and are in substantially parallel planes, machining end portions of said opposed surfaces while the side plates are held by said fixture so that the opposed said end portions are simultaneously transformed to have a part cylindrical configuration, whereby the radii of said opposed part cylindrical configurations have a common centre, locating between each said pair of opposed end portions a member having a surface substantially complementary to each said part cylindrical configuration of the respective said end portions, and securing said side plates to said members with each said part cylindrical configuration engaging a respective said substantially complementary surface.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

In the drawings

Figure 1:
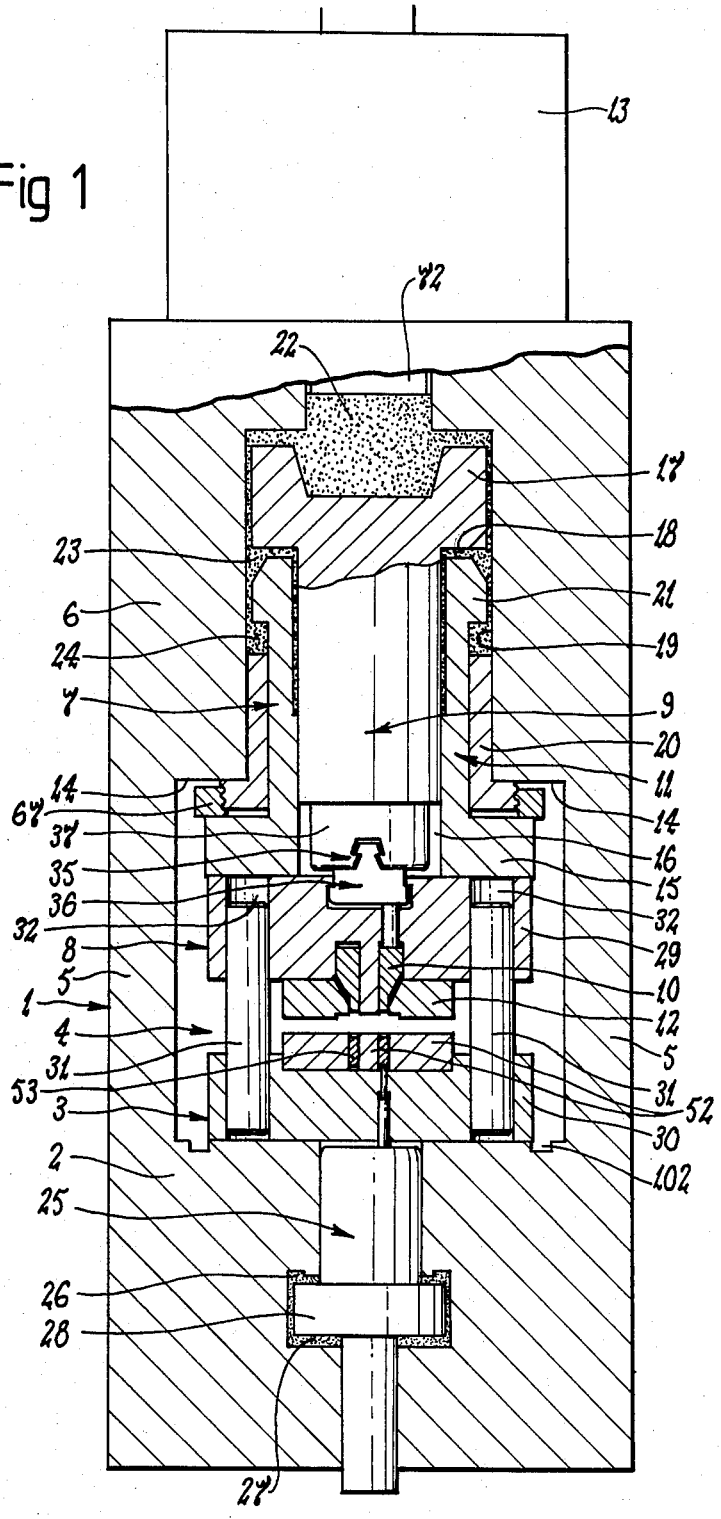
FIG. 1 is a diagrammatic cross-sectional view of one form of press incorporating an embodiment of the invention.
Figure 3:
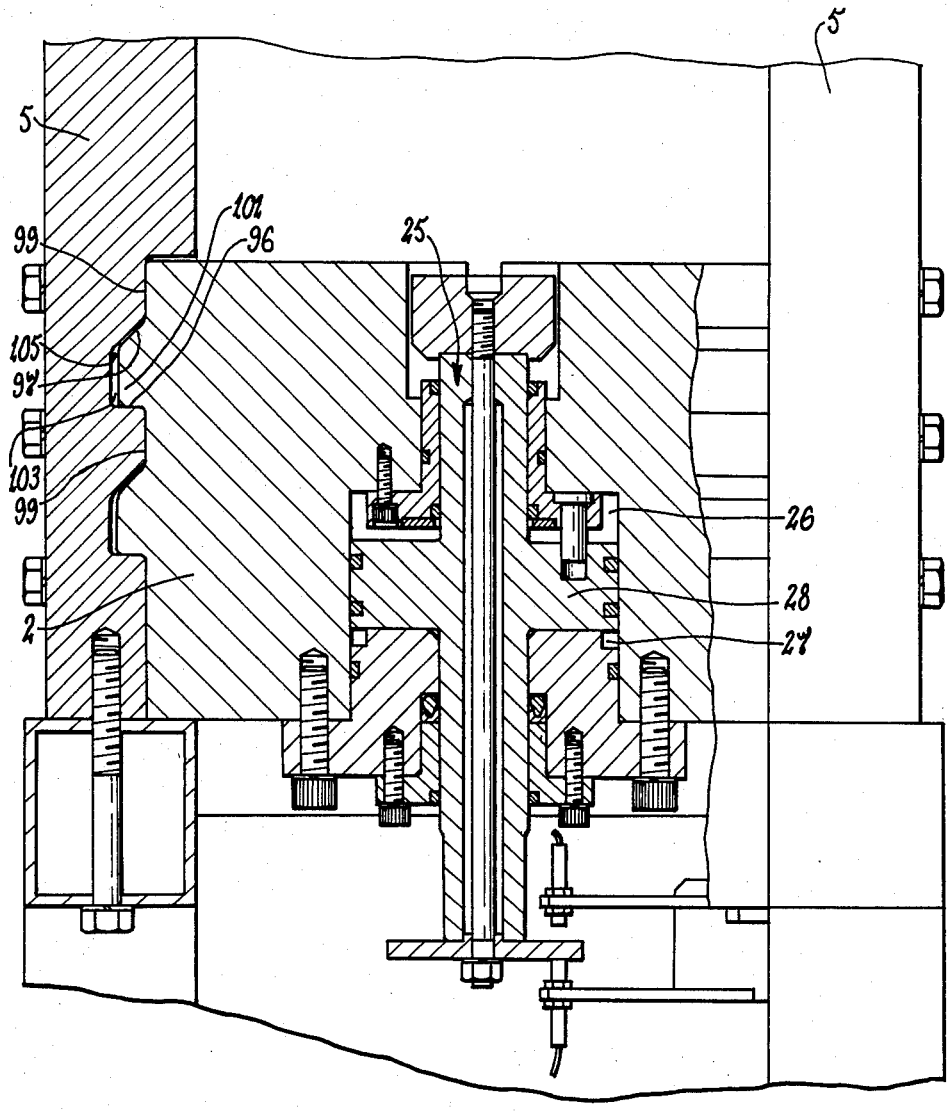
FIG. 3 is a cross-sectional view of a lower part of the same press as that shown by FIG. 2.
Figure 7:
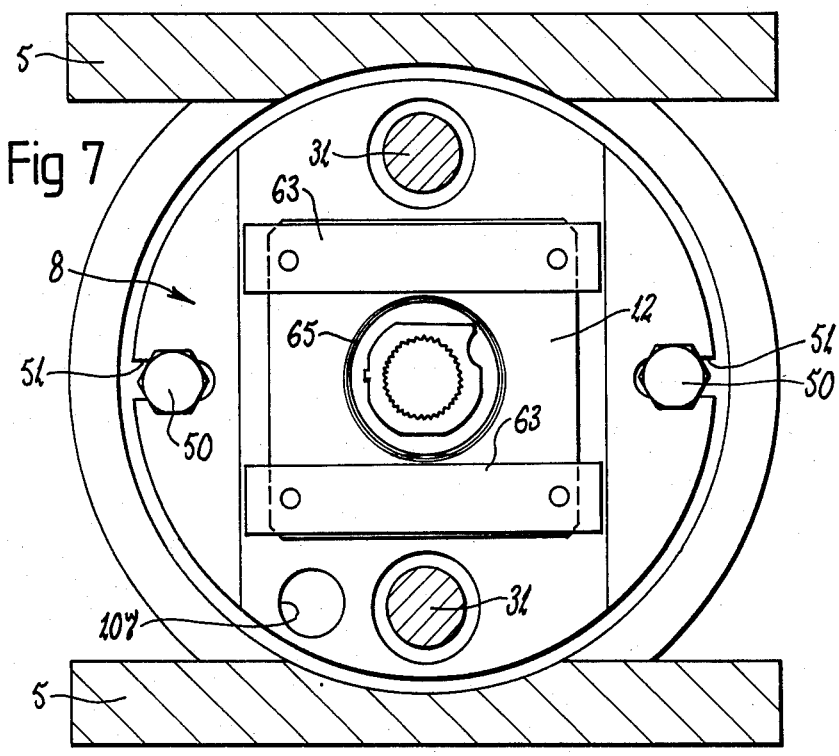
Figure 5:
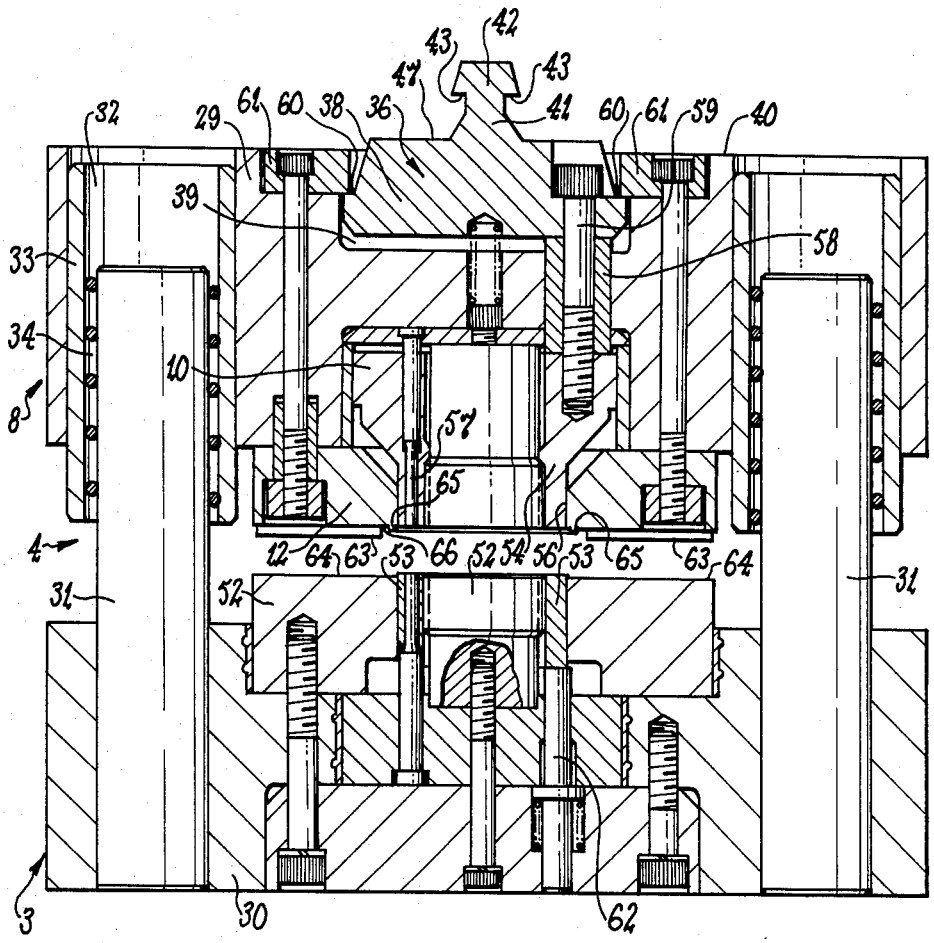
FIG. 5 is a cross-sectional view of an example die set for use in the press of FIGS. 2 and 3.
Figure 6:
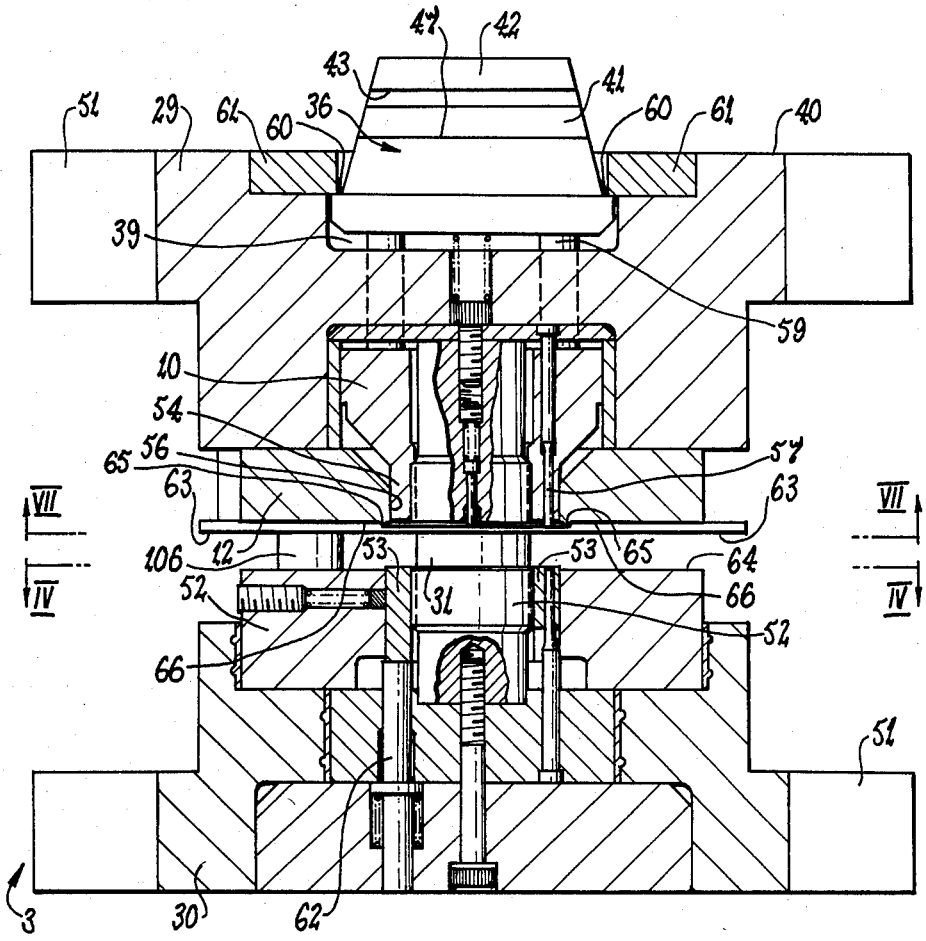
Figure 8:
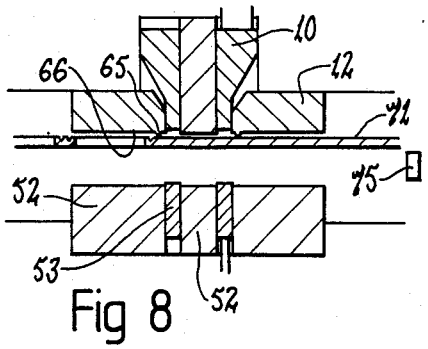
Figure 16:
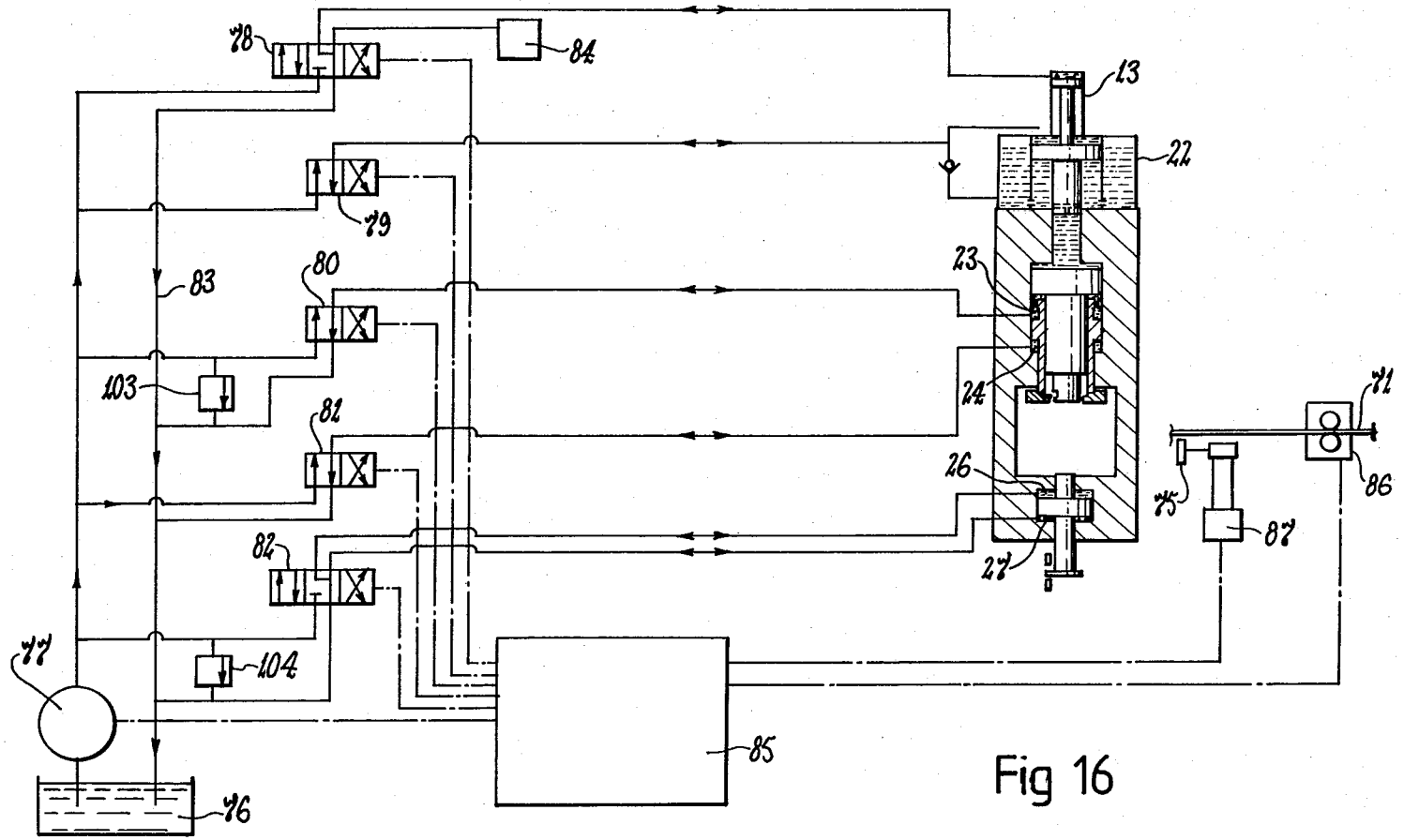
Figure 21:
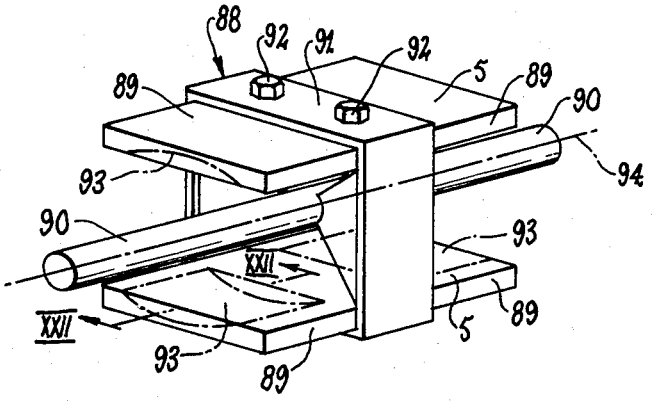
Figure 22:
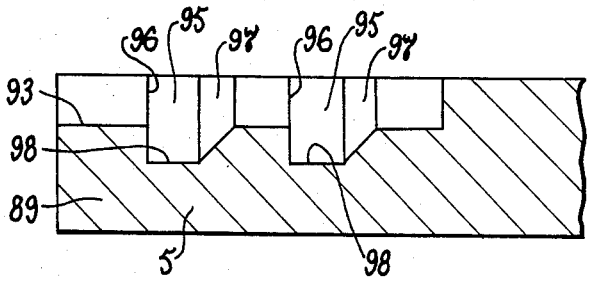

FIG. 6 a cross-sectional view taken along line VI—VI of FIG. 5;

FIG. 7 is a view taken in the direction of line VII—VII of FIG. 6;

FIGS. 8 to 15 are diagrammatic views showing the sequence of operations of a press as shown in FIGS. 1 and 3;

FIG. 16 is a schematic layout of the hydraulic and electrical control for a press of the kind shown by FIG. 1;

FIGS. 17 to 20 are diagrammatic views of a die set for use in the press and showing locking means and sensing means associated with that die set;

FIG. 21 is a diagrammatic perspective view of a fixture used in one method of constructing a press as shown in FIGS. 1 and 3; and FIG. 22 is an enlarged cross-sectional view taken along line XVIII—XVIII of FIG. 21.

It will be convenient to describe the invention with reference to one example form of press which is a hydraulically actuated fine blanking press. The invention is applicable, however, to other types of presses.

A typical press to which the invention is applicable is shown diagrammatically in FIG. 1 and includes a frame 1 having a base 2 which provides a support for the lower part 3 of a die set 4 and side plates 5 which extend upwardly from the base 2 in spaced relationship and provide a support for the working cylinder 6. A ram assembly 7 is slidably mounted in the cylinder 6 and is connected to the upper part 8 of the die set 4. The ram assembly 7 includes a primary ram 9 which drives the punch member 10 of the upper part 8 of the die set 4, and a secondary ram 11 which drives the vee ring plate 12 when such a plate is included in the upper part 8 of the die set 4. In an alternative arrangement which is not shown, the vee plate 12 is included in the lower part 3 of the die set 4 and in that case the primary ram 9 sliding within the secondary ram 11, and any suitable intensifier system 13 may be employed to drive the primary ram 9.

In the preferred construction shown, the secondary ram 11 projects out of the lower end 14 of the cylinder 6 and has an enlarged head portion 15 located externally of the cylinder 6. The primary ram 9 slides within an axial bore 16 of the secondary ram 11 and has a piston portion 17 located above the upper end 18 of the secondary ram 11 and slidably arranged within the cylinder bore 19. The lower end of the bore 19 may be closed by a suitable collar 20 which projects beyond the lower end 14 of the cylinder 6 and provides a guide for the lower end portion of the secondary ram 11. An enlarged piston portion 21 of the secondary ram 11 slides within the cylinder bore 19 between the collar 20 and the piston portion 17 of the primary ram 9.

Three pressure chambers are formed in the particular arrangement shown and described. A high pressure work chamber 22 is provided above the piston portion 17 of the primary ram 9, a low pressure set and strip chamber 23 is provided between the two piston portions 17 and 21 and a die open chamber 24 is provided between the secondary ram piston portion 21 and the collar 20. Each chamber 22, 23 and 24 is connectable to a pressure source and venting means through any suitable control system as hereinafter described.

A counter force ram 25 may be provided in the base 2 in coaxial relationship with the primary and secondary rams 9 and 11. Pressure chambers 26 and 27 are preferably provided on respective opposite sides of a piston portion 28 of the counter force ram 25 for a reason hereinafter made clear.

The die set includes upper and lower bolsters 29 and 30 each of which carries a respective die or die assembly. In accordance with usual practice, the bolsters 29 and 30 are retained in proper relationship by a plurality of guide pillars 31 which extend in the axial direction of the press and are located at the peripheral portion of the bolsters 29 and 30. In the example die set shown and which is best seen in FIGS. 5 and 6, each pillar 31 is secured to the lower bolster 31 and is slidably mounted within a respective guide bore 32 of the upper bolster 29 to allow the bolsters 29 and 30 to move towards and away from one another. In the particular arrangement shown, each guide bore 32 is formed by a bush 33 which is fixed within the bolster 29 and a ball bush 34 of known construction is provided between each pillar 31 and bore 32 to provide the required sliding engagement.

Connecting means 35 is provided for attaching the upper bolster 29 to the ram assembly 7 so that it will move with at least the secondary ram 11. The connecting means 35 is arranged so that the bolster 29 can be moved laterally into and out of attachment with the ram assembly 7, but when engaged holds the bolster 29 against separation from the ram assembly 7 in the axial direction of that assembly. In a preferred form as hereinafter described, one part of the connecting means 35 includes an adaptor 36 attached to the upper bolster 29 and another part is provided at the lower end 37 of the primary ram 9.

Figure 2:
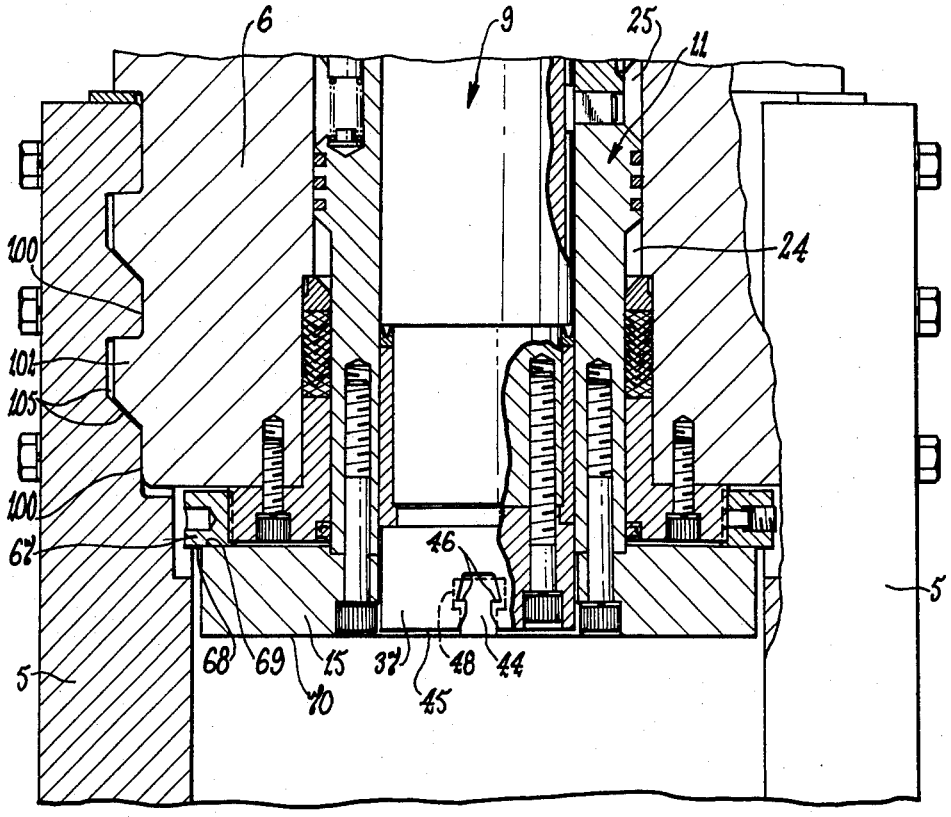
FIG. 2 is a cross-sectional view of an upper part of a press incorporating the aforementioned embodiment of the invention.

The aforementioned preferred form of the connecting means 35 is best shown by FIG. 2, which is a cross-sectional view of an upper part of a press of the general kind described with reference to FIG. 1. Consequently, corresponding components of the FIGS. 1 and 2 constructions will be given like reference numerals.

In the particular construction shown, an adaptor 36 has a body 38 which may be generally circular in cross-sectional shape and which is located within a substantially complementary cavity 39 provided in the upper surface 40 of the bolster 29. A projection 41 extends upwardly from the adaptor body 38 and that projection 41 has an enlarged portion 42 which is spaced from the adaptor body 38 in the axial direction of the press. The projection 41 could be a transversely extending rib as shown in FIG. 6, or it could be a pin-like member of circular cross-section. In any event, the enlarged portion 42 forms shoulders 43 on opposite sides of the projection 41 which face towards the adaptor body 38 and which are best seen in FIGS. 5 and 6.

The primary ram part of the connecting means 35 comprises a transversely extending slot 44 which passes through at least one side of the lower end 37 of the primary ram 9 and has its open mouth at the lower face 45 of that ram 9. The transverse cross-sectional shape of the slot 44 is such that it slidably receives the adaptor projection 41 and has upwardly facing shoulders 46 which cooperate with the shoulders 43 of the projection 41 to prevent axial separation of the adaptor 34 and primary ram 9. An upper surface 47 of the adaptor body 38 bears against the lower face 45 of the primary ram 9 to hold the two members against relative axial movement.

In the typical arrangement shown, the lower end portion 37 of the primary ram 9 is contained, at least substantially, within the bore 16 of the secondary ram 11 at all times. Access to the connecting means slot 44 of the primary ram 9 may then be achieved through a suitably shaped transverse access slot 48 provided through at least one side of the head portion 15 of the secondary ram 11 and which is shown in broken line in FIG. 2. The access slot 48 may be of T or other suitable cross-sectional shape to allow the adaptor projection 41 to pass laterally therethrough for installation and removal of the die set 4.

Figure 4:
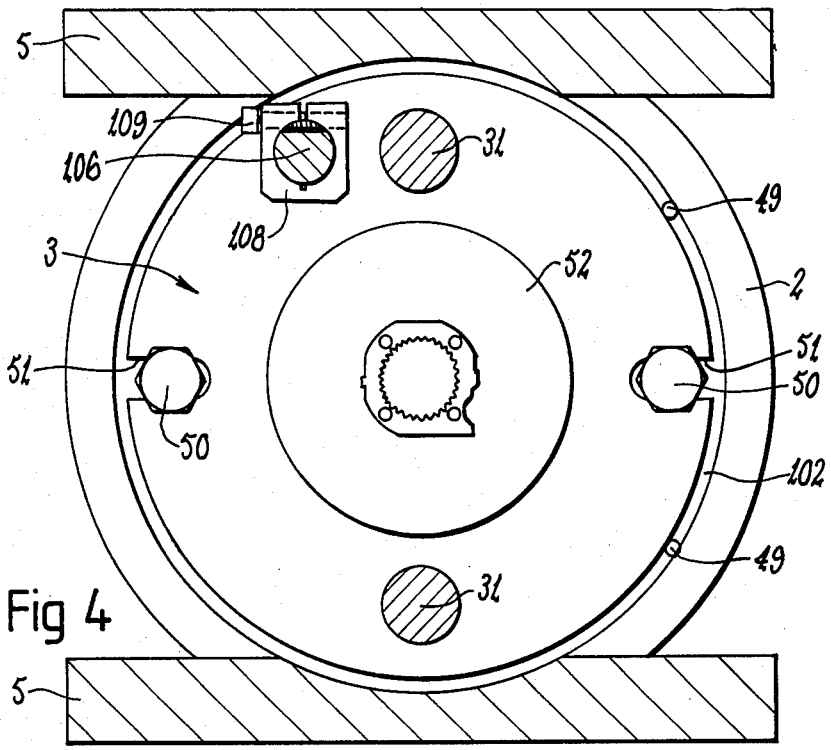
FIG. 4 is a plan view taken along line IV—IV of FIG. 6.

It is preferred to provide locating means to automatically centralise the die set 4 relative to the rams 9, 11 and 25 during installation. Such means may comprise at least two locating pins 49 (FIG. 3) projecting upwardly from the base 2 and which engage one side of the lower bolster 30 when that bolster 30 is correctly positioned. Any suitable retaining means may be employed to hold the bolsters in the correctly installed position. As shown in FIGS. 4 and 7, such means may comprise fastening bolts 50 which pass through laterally opening slots 51 of the bolsters 29 and 30 and engage within appropriately threaded holes (not shown) provided in the secondary piston head portion 15 and the base 2 respectively. The bolts 50 can be conveniently released to allow removal of a die set 4. Also, any suitable means may be provided to hold the bolsters 29 and 30 separated during installation and removal—e.g., a friction locking ring as hereinafter described in relation to FIGS. 17 to 20.

According to the example die set 4 shown in the drawings, and in particular FIGS. 2 to 7, the vee ring plate 12 and a movable punch 10 are associated with the upper bolster 29 and a die plate 52 and counterpunch 53 are associated with the lower bolster 30. The die plate 52 forms the backing member for the vee ring plate 12 and consequently those two components are arranged in opposed relationship. The movable punch 10 and the counterpunch 53 are also in opposed relationship and are shaped to suit the shape of the part to be blanked.

As best seen in FIGS. 5 and 6, the vee ring plate 12 is secured to the underside of the upper bolster 29 so as to be held against movement relative thereto and surrounds the lower or operative end portion 54 of the movable punch 10. The punch 10 is mounted for limited axial movement relative to both the vee ring plate 12 and the upper bolster 29 and for that purpose slides within axial bores 55 and 56 of the bolster 29 and vee ring plate 12 respectively. The bore 56 preferably has a diameter smaller than that of the bore 55. If the shape of the operative portion 54 of the punch 10 is suitable, the punch 10 may also slide along one or more guide rods 57 which are attached to the upper bolster 29 and extend in the axial direction of the press.

Operative movement of the movable punch 10 may be achieved in any suitable fashion, but in the construction shown and described, the adaptor 36 effects that movement through a plurality of force transferring columns 58 (FIG. 5) which are slidably mounted in the upper bolster 29. The body portion 38 of the adaptor 36 locates within the cavity 39 of the upper bolster 29 as previously described, and each of the columns 58 extends between that cavity 39 and the bore 55 of the upper bolster 29 within which the movable punch 10 is located. Each column 58 is engaged at its opposite ends by the adaptor 36 and the movable punch 10 respectively and at least one column 58 may be secured to the adaptor 36 and movable punch 10 by a stud 59 or other fastener to ensure that the adaptor 36 and punch 10 move together.

Movement of the adaptor 36 axially out of the bolster cavity 39 is prevented by engagement between an upwardly facing shoulder 60 of the adaptor 36 and an overlying abutment member 61 which is secured to the bolster 29. When the shoulder 60 and member 61 engage, the upper bolster 29 will follow upward travel of the primary ram 9. When the movable punch 10 is operated, however, the adaptor 36 moves downward relative to the upper bolster 29 so that the shoulder 60 and member 61 separate. That is, a lost motion facility is built into the connection between the working ram 7 and the die set 4 and that is achieved, in the example shown, by having a greater separation between the member 61 and the base of the cavity 39 than between the shoulder 60 and the undersurface of the adaptor body 38. The lost motion facility enables operation of the punch 10 separate from operation of the vee ring plate 12 and also enables presetting of the delay between commencement of the respective working strokes of the punch 10 and the vee ring plate 12.

The die plate 52 is secured to the lower bolster 30 against relative movement and the counterpunch 53 is slidably mounted within that plate 52 for relative movement in the axial direction of the press. A plurality of pressure pins 62 may be slidably mounted in the lower bolster 30 and arranged to transfer force from the counter-force ram 25 to the underside of the counterpunch 53.

It is preferred that the upper and lower parts 8 and 3 respectively, of the die set 4 are arranged so that opposed surfaces abut in the closed condition of the die set 4. For example, as shown in FIG. 5, the vee ring plate 12 may be stepped downwardly on opposite sides of the region which receives the material to be blanked so as to provide stop surfaces 63 which abut the opposed surface 64 of the die plate 52 in the closed condition of the die set 4. Downward travel of the movable punch 10 relative to the upper bolster 29 can be limited in any appropriate manner. It is preferred, however, that the piston portion 17 of the primary ram 9 engages the upper end 18 of the secondary ram 11 for that purpose.

The vee ring 65 of the plate 12 is of known form and comprises a rib or like projection on a downwardly facing surface 66 of the vee ring plate 12 and which is of V shape in transverse cross-section. The rib or ring 65 surrounds the operative end portion 54 of the movable punch 10 and is located close to that portion 54 as known in the art. The surface 66 from which the ring 65 projects is spaced axially upwards from the stop surfaces 63 by a distance substantially equal to the thickness of the plate material to be blanked. That spacing may be different on opposite sides of the ring 65 so that it corresponds substantially to the minimum and maximum plate thickness on the sides adjacent and remote from the movable punch 10 respectively.

Adjustable stop means is preferably provided to limit the open position of the die set 4 during operation of the press. In the construction shown, and as best seen in FIG. 2, that stop means includes a ring nut 67 which threadably engages with a projecting lower end portion of the collar 20. Rotation of the ring nut 67 relative to the collar 20 therefore varies the axial position of the ring nut 67 on the collar 20. An undersurface 68 of the ring nut 67 is arranged to engage an opposed upwardly facing surface 69 of the external head portion 15 of the secondary ram 11 and thereby limit upward travel of that ram 11. Upward travel of the upper bolster 29 is in turn limited by engagement of that bolster 29 with an undersurface 70 of the secondary ram head portion 15.

When it is desired to install or remove a die set 4, it may be necessary to adjust the ring nut 67 upwardly so that the connecting slot 44 of the primary ram 9 can be brought into alignment with the access slot 48 of the secondary ram 11.

A particular advantage of the arrangement described is that the press can be arranged to receive any one of a plurality of different die sets 4, each of which has substantially the same open height. That is, the die set height can be standardized so simplifying setting-up time when a die set 4 is changed. The change-over procedure is also greatly simplified by the fact that the upper bolster 29 is automatically connected to the working ram 7 as a consequence of lateral movement into the press. Once the die set 4 is in position, the ring nut 67 can be turned to a position to fix the operative open position of the die set 4.

FIGS. 8 to 15 show, in diagrammatic form, the essential components of the die set 4 and their manner of cooperation and operation during a single work cycle of the press.

When a press as described is set ready to blank a part from sheet material, the die set 4 is held in the open position by interaction between the primary ram 9, adaptor 36 and upper bolster 29 respectively. Sheet material may be fed into the press in strip form and such a strip 71 will be positioned to locate between the stop surfaces 63 of the vee ring plate 12. After the strip 71 is properly located, as in FIG. 8, the intensifier system 13 may operate to close the die set 4, which is the condition shown in FIG. 9. For example, the intensifier system 13 may include a quick traverse ram 72 (FIG. 1) which operates to rapidly close the die set 4 at a relatively low energy level. The secondary and primary rams 11 and 9 move together during that closing movement and retain their initial axial relationship because a suitable pressure is maintained within the lower pressure set and strip chamber 23 at all times.

Figure 9:
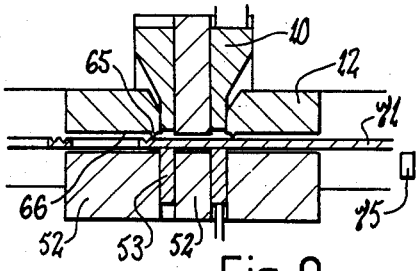
Figure 10:
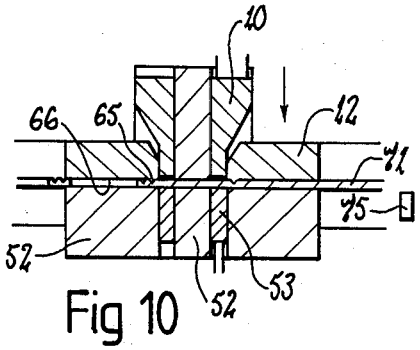

At the end of the fast closing movement, the strip material 71 is clamped between the vee ring 12 and the die plate 52 as shown in FIG. 9. Increased pressure within the high pressure work chamber 22 then causes the ram assembly 7 to drive the vee ring plate 12 to move through a working stroke so that the ring 65 is embedded into the upper surface of the strip 71 (FIG. 10). That is, the pressure within the chamber 23 is such that the primary and secondary rams 9 and 11 continue to move together during this stage of the operation. Opposed surfaces 63 and 64 of the vee ring plate 12 and the die plate 52 come into engagement to terminate the working stroke of the vee ring plate 12.

Figure 11:
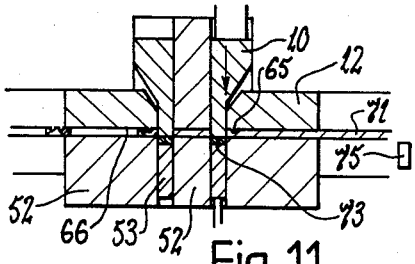
Figure 12:
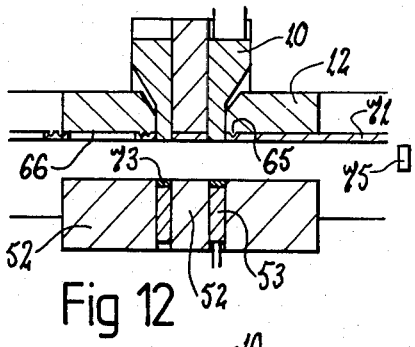

The pressure within the chamber 22 is then increased further and when that pressure reaches a predetermined level the chamber 23 exhausts to permit the primary ram 9 to move downwards relative to the secondary ram 11. The movable punch 10 is thereby caused to moved relative to the vee ring 12 and perform a working stroke during which it is driven against and penetrates the strip 71 as shown in FIG. 11. The section 73 of the strip 71 underlying the punch 10 is driven against the pressure of the counter-punch 53 which retracts in response to the downward movement of that section 73. The strip section 73 is therefore driven into a correspondingly shaped recess or cavity in the die plate 52 which is formed by the receding counterpunch 53. When the movable punch 10 has completed its downward travel the strip section 73, which is the part to be blanked, is completely separated from the body of the strip 71 and is located in the die plate recess as shown in FIG. 11.

During the aforementioned operation the counterpunch 53 is forced downwards against the influence of the counterforce ram 25 which is urged upwards by pressure within the chamber 27. The chamber 27 exhausts at a predetermined pressure as hereinafter explained so as to allow the foregoing operation to take place. At the same time fluid is drawn into the chamber 26 so as to provide resistance to subsequent upward travel of the counterforce ram 25.

It will be understood from the foregoing that the vee ring plate 12 is held firm against the strip 71 during operation of the movable punch 10. That is achieved through the secondary ram 11 which remains under pressure as the primary ram 9 moves downwardly through the secondary ram 11 to operate the movable punch 10. It will be also appreciated that the movable punch 10 travels through a short distance relative to the secondary ram 11 and that distance is predetermined prior to installation of the die set 4 within the press. That is, the movable punch 10 moves from a predetermined position relative to the vee ring plate 12 and that position is selected to avoid excessive movement and thereby ensures maximum conservation of energy and maximum speed of operation.

In the construction particularly described, the aforementioned predetermined position of the movable punch 10 is established by engagement of the opposed surfaces of the adaptor 36 and the abutment member 61 which is fixed to the upper bolster 29. That engagement fixes the distance by which the movable punch 10 trails behind the vee ring plate 12 during the time that the primary and secondary rams 9 and 11 travel downwards together. It is of significant advantage that the movable punch 10 is moved from a position which is fixed before installation of the die set 4 within the press and which applies for each operation of the punch 10. That position is built into the die assembly, but may be varied by the use of shims or the like at the discretion of the tool designer. That is, it is not intended that such adjustment be effected by the press operator as standard procedure.

Figure 13:
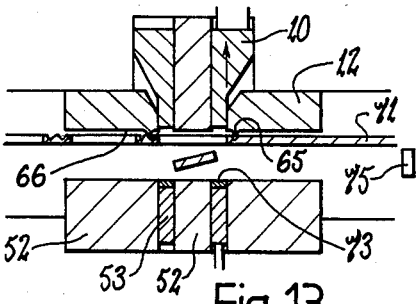

The die set 4 is opened by applying pressure to the die open chamber 24 so as to cause the working ram 7 to move upwards. The movable punch 10, however, has penetrated through the strip 71 during the blanking operation and consequently that strip 71 is carried upwards with the movable punch 10. At the end of the upward stroke of the secondary ram 11, as determined by the ring nut 67, the various components have the relative positions shown by FIG. 12. At that time the pressure existing within the low pressure set and strip chamber 23 takes over to cause further upward travel of the primary ram 9 so that the movable punch 10 is carried upwards with the primary ram 9 and is thereby removed from the strip 71 as shown in figure 13. Also, any waste material 74 separated during the blanking operation will then drop from the strip 71 onto the lower bolster 30.

Figure 14:
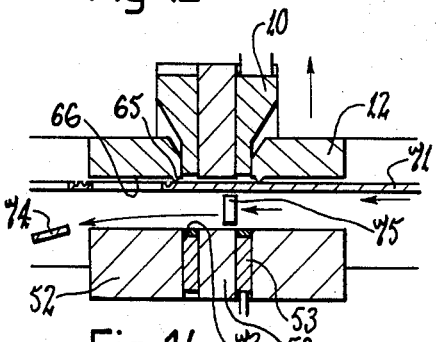
Figure 15:
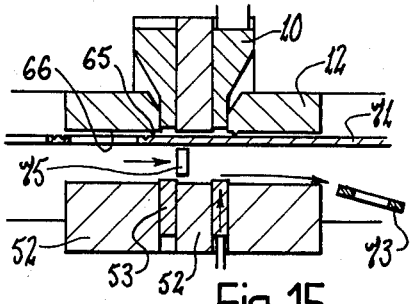

In a preferred arrangement, removal of waste material 74 is effected by means of a blade 75 which sweeps across the surface of the lower bolster 30, preferably in the direction of feed of the strip 71 as shown in FIG. 14. The sweep blade 75 may be driven pneumatically or in any other appropriate manner, and it is generally convenient to first feed the strip 71 to its next position for blanking (as shown in FIG. 14) and then move the sweep blade 75 across the lower bolster 30 in the same direction to remove any waste material 74 left on the surface of that bolster 30.

The sweep blade 75 is subsequently caused to travel back across the lower bolster 30 to the side from which it came. Before doing that, however, pressure is applied to the chamber 27 and the chamber 26 is opened to exhaust so that the counterforce ram 25 is operated to push the counterpunch 53 upwards and thereby eject the blanked part 73 from the die plate recess. As a result, the blanked part 73 is exposed at the top of the lower bolster 30 for engagement by the sweep blade 75 as that blade moves back to its original position. The blanked part 73 is thereby cleared from the lower bolster 30 and is deposited into an appropriate receptacle or discharge system.

A parts removal system as described above has several advantages, one of which is the positive nature of the removal action. Another advantage is the ability of the system to move the part 73 in a particular state of orientation—for example, with the burr uppermost on the part 73—so that it does not require re-orientation for further processing such as linishing. A further advantage is the relatively rapid operation of the system.

It is preferred that the sweep blade 75 fits neatly between the opposed surfaces of the lower bolster 30 and the strip 71 so that any part of scrap left between those surfaces cannot avoid contact with the blade 75. Thus, a malfunction is indicated if the blade 75 fails to complete a pass through the die set 4 and suitable corrective action can be taken.

FIG. 16 shows in schematic form the general layout of the control system for the press as described above. The system includes a reservoir 76 for hydraulic fluid, a pump 77 for drawing fluid from the reservoir 76 to the press, and appropriate control valves 78, 79, 80, 81 and 82. The valve 78 connects the pump 77 and a drain 83 to the intensifier system 13 and also to a scrap cutting tool 84 which forms no part of the present invention and consequently will not be described. The valve 79 connects the pump 77 to the high pressure chamber 22, the valves 80 and 81 connect the chambers 23 and 24 respectively to the pump 77 and the drain 83 as required, and the valve 82 connects the chambers 26 and 27 to the pump 77 and the drain 83 as required. Operation of the various valves is effected through suitable control means 85 which may include a sequential micro-processor which can be programmed according to requirements.

The valves 76 to 82 are operated in appropriate sequence and manner through the control means 85 so as to achieve the order of operations previously described in connection with FIGS. 8 to 15. Suitable pressure sensing and responsive devices may be associated with the valves 78 to 82 and/or the control means 85, to assist in that regard. By way of example, a pressure relief valve 103 is associated with the valve 80 and its connection to the chamber 23 so as to regulate the pressure at which that chamber exhausts to permit downward movement of the primary ram 9 relative to the secondary ram 11. A similar pressure relief valve 104 is associated with the valve 82 and its connection with the chamber 27 so that chamber will exhaust at a predetermined pressure during retraction of the counterforce ram as illustrated by FIGS. 10 and 11.

It is preferred that the control means 85 also regulates operation of feed means 86 for the strip 71 and drives means 87 for the sweep blade 75. Suitable interlocking may be incorporated within the control means 85 to ensure that operation of the feed means 86 and the drive means 87 respectively is correctly synchronized with other operations of the press.

Figure 17:
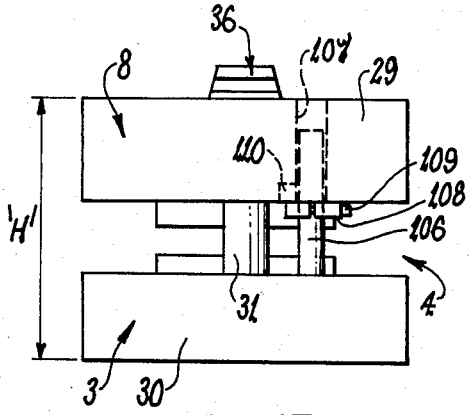

One of the important advantages of a press as described is that all die sets 4 for use in the press can have a predetermined and standard open height "H" (FIG. 17). That is the overall height of the die set 4 when in the fully open position. FIGS. 17 to 20 show, in diagrammatic form, an example method of locking the die set 4 in the fully open position for the purpose of removal from and replacement in the press, as well as storage out of the press.

In the example arrangement shown, an upstanding pin 106 is fixed to the lower bolster 30 and slidably locates within a hole 107 formed in the upper bolster 29. Locking means in the form of a split collar 108 is located on the pin 106 and has a clamping screw 109 which is adjustable to place the collar 108 in either an operative condition or an inoperative condition. The collar 108 frictionally engages the pin 106 so as to resist movement along that pin 106 when in its operative condition, and is freed for easier movement along the pin 106 when in its inoperative condition. When the collar 108 is in its operative condition, the frictional engagement with the pin 106 is preferably such that a substantial force is necessary to move the collar 108 along the pin 106.

FIG. 17 shows the die set 4 in the fully open position and the collar 108 at a stop position at which it engages a lower surface of the upper part 8 of the die set 4. The surface which engages the collar 108 under those circumstances can be formed by any appropriate part of the die set 4, or a member secured thereto. When the die set 4 is being removed from or replaced in the press, the collar 108 is secured in its operative condition so that the die set 4 is held in the fully open position, and the collar 108 can maintain that condition during storage of the die set 4 for future use. Thus, all die sets 4 suitable for use with the press can be stored ready for location within the press without the need for adjustment prior to or subsequent to such location. Also, the open position of the die set 4 is such that the die set 4 will be automatically engaged with the slot 44 of the primary ram 9 when that die set 4 is supported on the base 2.

Figure 18:
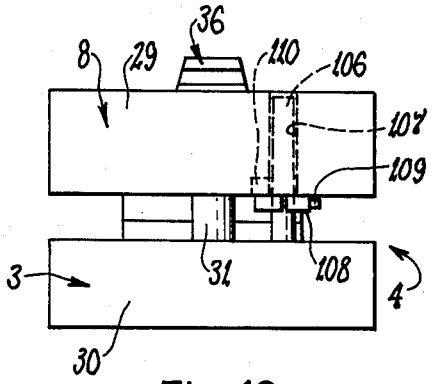
Figure 19:
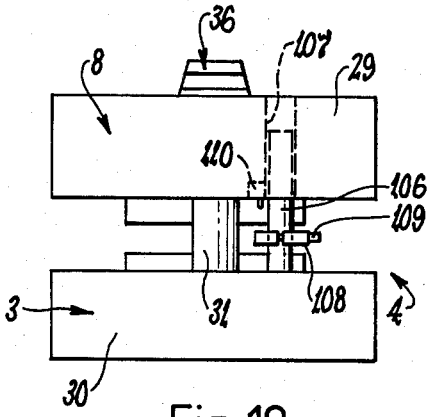

When the die set 4 is located in the press ready for use, the clamping screw 109 remains in the position of adjustment corresponding to the operative condition of the collar 108. Initial operation of the press to close the die set 4, then causes the collar 108 to be pushed down the pin 106 by its engagement with the upper part 8 of the die set 4. At the closed position of the die set 4, the collar 108 will have adopted a rest position which is shown by FIG. 18 and at which it is still engagable by the aforementioned surface of the upper die set part 8. The collar 108 will retain that rest position during subsequent operation of the die set 4 because of its frictional engagement with the pin 106 (see FIG. 19). When it is desired to remove the die set 4 from the press, the screw 109 is adjusted to place the collar 108 in its inoperative condition and the collar 198 can then be manually moved back to the stop position and clamped in that position by readjustment of the screw 109 to place the collar 108 in its operative condition.

It will be apparent that the die set locking means can have a form different to that particularly described.

Sensing means may be provided to sense when the die set 4 is fully closed and then instruct the control means 85 to proceed to the next sequence of operation. That is, the press will not commence the first stage of the high energy operation, which is to drive the vee ring plate 12 through its working stroke, until after completion of the fast closing low energy stage. In the particular arrangement shown in FIGS. 17 to 20, the collar 108 forms part of that sensing means in that it influences operation of a switch 110 which is connected to the control means 85 in an appropriate manner. That is, when the die set 4 is fully closed, the switch 110 engages the collar 108, or is otherwise influenced by the relationship adopted between the upper die set part 8 and the collar 108, so as to operate and thereby enable the control means 85 to proceed to cause the press to continue the operating sequence.

Figure 20:
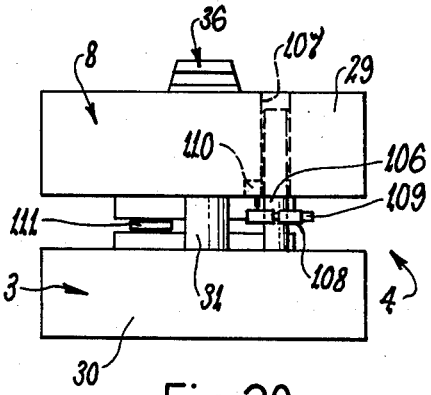

In the event that a piece of material 111 is inadvertantly left between the upper and lower parts 8 and 3 respectively of the die set 4 as shown in FIG. 20, the die set 4 will be prevented from closing and consequently the switch 110 will not be operated. Such sensing means therefore prevents the press from continuing to operate to enter into the high energy stages when the space between the die set parts 3 and 8 has not been cleared. Other forms of sensing means may be adopted for the same purpose.

A press as described has the advantage of relative simplicity without loss of effectiveness. The ability to change die sets quickly is of significant advantage as is the ability to adopt a standard die set height.

Several factors contribute towards achievement of the foregoing advantages. Of particular importance is the fact that the die set 4 has built into it certain datum determining features. One such feature is the engagement between the opposed surfaces 63 and 64 of the die set 4 which establishes a fixed location for the vee rig plate 12 at the end of its working stroke. Another is the engagement between the adaptor shoulder 60 and the abutment member 61 as the primary ram 9 is moved upwards relative to the secondary ram 11, as that fixes the delay between termination of the working stroke of the vee ring plate 12 and commencement of the working stroke of the punch 10. Since those datums are built into the die set 4, it is possible to have several die sets which are adapted to form different components, but which require no special adjustment for use in the press.

The lateral mounting and demounting facility is important in enabling the die set 4 to be moved into and out of the press without the need to change the setting or relationship of the operative tools of the die set 4. Another relevant feature is the engagement between the primary ram 9 and the secondary ram 11 for the purpose of terminating the working stroke of the punch 10.

It therefore follows that a fixed datum is established for the critical operations of the die set 4 and that permits standardization of die sets for use in the press.

The invention also contemplates an improved method for manufacturing a press of the foregoing kind, but that method is also applicable to presses other than that particularly described. The method is characterized in that the side plates 5 of the press are mounted on a fixture 88, as shown diagrammatically in FIG. 17, for the purpose of machining end portions 89 which engage the base 2 and cylinder 6 respectively of the press. That is, the end portions 89 which are located in opposed relationship are machined simultaneously so ensuring uniformity and accuracy as hereinafter explained.

In one form of the method, the side plates 5, which may be flat rectangular sections of metal, are secured to a rotatable fixture 88 of suitable form. Alternatively, the fixture 88 may be adapted for statinery mounting, but it will be convenient to hereinafter particularly describe the rotatable fixture arrangement.

The fixture 88 may take any appropriate form, but in the example shown comprises a spindle 90 having a parallel sided mounting section 91 between its ends. That is, oppositely facing side surfaces of the mounting section are parallel, extend in the direction of the axis of the spindle 90 and are spaced from that axis by the same distance. In a preferred form (not shown), there are two sets of such surfaces so that the mounting section 91 is square in cross-section. Although the following description refers to simultaneous machining of the two plates 5, the fixture 88 could have four plates 5 secured to it for machining at the same time. Other types of fixtures could carry an even greater number of plates 5.

Each side plate 5 is secured to a respective side of the mounting fixture 88 by studs 92 or other fastening means and so as to extend in the longitudinal direction of the spindle 90. The two side plates 5 intended for the same press are secured to respective opposite sides of the mounting section 91 as shown in FIG. 21. The opposite end portions of each side plate 5 extend beyond the mounting section 91 so that a space exists between them and the spindle 90.

The fixture 88 may then be mounted in a lathe or other suitable machine such as by having one end of the spindle held by a chuck (not shown) and the opposite end engaged by a tailstack centre or a three-point steady (not shown). A suitable cutting tool (not shown) can then be introduced into the aforementioned space so that, upon rotation of the fixture 88, the exposed internal surface of each plate 5 can be machined as required to form a part-cylindrical surface 93. Since both plates 5 are machined simultaneously, uniformity can be assured and furthermore, the machined surfaces 93 of the two plates 5 will be accurately related in that they are formed about a common and specific centre 94.

In the arrangement shown, each plate end portion 89 is machined to have a curved groove internal surface 93. For example, there may be two circumferentially extending grooves 95 spaced apart in the axial direction of the fixture 88 as shown in FIG. 18. Each groove 95 may be shaped so that one side surface 96 is substantially at right angles to the fixture axis 94 and the opposite side surface 97 slopes outwardly from the groove base 98. The right angle surfaces 96 may form bearing surfaces and the arrangement is preferably such that the bearing surfaces 96 at the intended lower end of the plate 5 face upwardly and those at the intended upper end face downwardly as shown in FIGS. 3 and 2 respectively.

Side plates 5 machined as described above are adapted to cooperate with a base 2 and cylinder 6, both of which have a cylindrical or part-cylindrical outer surface 99 and 100 respectively corresponding to the part-cylindrical surface 93 of the relative end portion 89 of the plates 5. The base and cylinder surfaces 99 and 100, however, are provided with circumferential ribs 101 (FIGS. 2 and 3) which are substantially complementary to the side plate grooves 95 in transverse cross-section, but usually slightly smaller for a reason hereinafter made clear. The base 2 may also be provided with a circumferential groove 102 (FIGS. 1 and 4) in its upper surface and that is preferably machined in the same sequence of operations during which the outer cylindrical surface 99 is formed so as to ensure that the groove 102 and outer surface 99 are coaxial. Location of the locating pins 49 within that upper surface groove 102 provides for accurate location of the die set 4 relative to the centre line of the press, which is fixed at the centre about which the various machining operations take place.

When the press is assembled, each side plate 5 has its cylindrical end surfaces 93 bearing against the corresponding cylindrical surfaces 100 and 99 of the cylinder 6 and base 2 respectively. The ribs 101 are therefore located within corresponding circumferential grooves 95 of the side plates 5 and preferably with clearance 105 (FIGS. 2 and 3) so that the opposed right angle bearing surfaces of the ribs 101 and grooves 95 abut one another. In the case of the cylinder 6, a lower end surface of that may also abut an upwardly facing step of the two side plates 5 which is formed at the junction between the cylindrical and flat surfaces of those plates 5, but that is not shown.

A method as described above has the substantial advantage of ensuring central location and relative squareness of critical components, which has been extremely difficult to achieve in prior constructions. In producing a press according to the new method, only three basic machining operations are required to control accuracy and alignment of the press components. Furthermore, use of curved abutment surfaces between the side plates 5 and cylinder 6 and base 2 reduces the risk of side plate bending because the line of force at each side of the press is contained within the body of a respective side plate 5.

Yet another advantage of the arrangement described is the modular nature of the press. For example, various types of bases could be used within a common main frame. Other advantages will be apparent to persons skilled in the relevant art.

Various alterations, modifications and/or additions may be introduced into the construction and arrangement of parts previously described without departing from the spirit or ambit of the invention as defined by the appended claims.

Having now described my invention what I claim as new and desire to secure by Letters Patent is:

1. A metal working press including, base, a cylinder supported above said base, a working ram assembly axially movable towards and away from the base and comprising a primary ram and a secondary ram which are arranged substantially coaxial and are movable axially relative to one another, said secondary ram is slidable axially within said cylinder and said primary ram is slidable axially within an axial bore of the secondary ram, a die set located between said base and said ram assembly and being removable from the press to enable replacement by another said die set, said die set including upper and lower die assemblies and means interconnecting those die assemblies so that they are movable towards and away from each other in the axial direction of said ram assembly, said upper die assembly including two die members which are relatively movable in said axial direction and each of which is arranged to be driven towards said base through a working stroke by a respective one of said rams, connecting means including cooperable parts of said primary ram and said upper die assembly which operates to prevent separation of said ram assembly and said die set in said axial direction but allows such separation in a direction transverse to said axial direction so that the die set can be moved into and out of the press in said transverse direction, means releasably retaining said die set against said transverse separation, and three pressure chambers provided within said cylinder, one said chamber is a high pressure chamber and the end of said primary ram remote from said die set is exposed to that chamber, another said chamber is a set and strip chamber and opposed surfaces of said primary and secondary rams which extend transverse to said axial direction are exposed to that chamber, the other said chamber is a die open chamber and a surface of said secondary ram which faces in the opposite direction to said opposed surface thereof is exposed to that chabmer, and said set and strip chamber is located between the other two said chambers.

2. A press according to claim 1, wherein each said die assembly includes a bolster and at least two die members attached to the respective bolster, and the die set part of said connecting means includes an adaptor which is attached to the bolster of the upper die assembly and slidably engages with an end portion of said primary ram so as to be movable relative thereto in said transverse direction.

3. A press according to claim 2, wherein said adaptor is attached to said upper bolster so as to be capable of limited movement relative thereto in said axial direction, and one said die member of the upper die assembly is connected to said upper bolster so as to move relative to the other said die member of the upper die assembly in response to movement of said adaptor relative to said upper bolster in said axial direction.

4. A press according to claim 3, wherein said one die member is a punch and theother said die member is a vee ring plate.

5. A press according to claim 5, wherein said vee ring plate includes a projecting rib which is substantially of V shape in transverse cross section and an abutting surface which engages an opposed surface of the lower die assembly to limit penetration of said rib into a work piece interposed between the two die assemblies.

6. A press according to claim 1, wherein one said part of the connecting means has a transverse slot therein which has a cross sectional shape such as to provide at least one shoulder facing generally in said axial direction, the other said connecting means part has a projection having a shape substantially complementary to said cross sectional shape so as to be slidable along said slot, and said axial separation is prevented at least in part by engagement between said projection and said shoulder.

7. A press according to claim 6, wherein said slot is formed in a lower end of said primary ram and said projection is provided on said die set.

8. A press according to claim 1, wherein said relative movement between the two said die members is limited in one direction by engagement between the two said rams and is limited in the opposite direction by said connecting means.

9. A press according to claim 1, wherein opposed surfaces of said upper and lower die assemblies engage to fix the closed position of said die set, said connecting means operates to fix the fully open position of said die set, lost motion means is included in said connecting means to allow limited axial movement of the two said rams and thereby permit said primary ram to drive one of said die members through the working stroke thereof relative to the other said die member, and opposed surfaces of said primary and secondary rams abut to terminate the working stroke of said one die member.

10. A press according to claim 9, wherein locking means is provided for releasably holding said die set in said fully open position, and said fully open position is maintained during removal and replacement of said die set from and to the press respectively.

11. A press according to claim 1, wherein control means is provided to regulate the sequence of application of pressure to each said chamber and to also regulate the magnitude of the pressure in each said chamber, said control means being operable to subject said high pressure chamber to relatively high pressure so as to cause simultaneous movement of said primary and secondary rams towards said base and subsequently cause movement of the primary ram relative to the secondary ram in the same direction when the secondary ram is held against further movement towards said base by engagement of the die set with a work piece, to thereafter vent said high pressure chamber and subject said die open chamber to relatively low pressure to cause simultaneous movement of said primary and secondary rams away from said base, and to subsequently subject said set and strip chamber to pressure to cause said primary ram tp move relative to said secondary ram in a direction away from said base.

12. A press according to claim 11, wherein said working ram assembly is operatively connected to an intensifier system which is operable to simultaneously move said primary and secondary rams towards said base and thereby cause fast closing of said die set, and to thereafter cause said die set to function so that the die members thereof each moves through a said working stroke while engaging a workpiece located within said die set.

13. A press according to claim 12, wherein said control means includes pressure responsive means which is operable to control the pressure at which said set and strip chamber exhausts and thereby control the pressure within said high pressure chamber when said primary ram moves towards said base relative to the secondary ram.

14. A press according to claim 1, wherein a counterforce ram is provided in said base in axial alignment with the working ram and is movable towards and away from said working ram assembly, and at least one counterpunch is connected to said counterforce ram for movement therewith and forms part of said die set.

15. A press according to claim 1, wherein the connection between the said working ram assembly and said upper die assembly is such that one of said die members is caused to move through its working stroke as a consequence of simultaneous movement of the two said rams and the other said die member is caused to move through its working stroke and relative to said one die member as a consequence of movement of said primary ram relative to the secondary ram after completion of said simultaneous movement.

16. A press according to claim 15, wherein opposed surfaces of said primary and secondary rams engage to complete said working stroke of said other die member.

17. A press according to claim 15, wherein lost motion means included in said connecting means permits limited travel of the primary ram relative to the secondary ram when said working ram assembly is returned towards the position held prior to operation of said working strokes, and said limited travel fixes the extent of the delay between the termination of the wroking stroke of said one die member and the commencement of the working stroke of said other die member.

18. A press according to claim 17, wherein stop means is arranged for engagement by said secondary ram and thereby limit the movement of said secondary ram away from said base, and said lost motion means thereafter functions to permit said limited relative travel of the primary ram.

19. A press according to claim 18, wherein the position of said stop means relative to said base is adjustable.

20. A press according to claim 1, wherein adjustable stop means is provided to limit the separation of said upper and lower die assemblies.

21. A press according to claim 20, wherein said stop means includes a ring nut which threadably engages with a stationery part of said press and is adjustable as a result of that threaded engagement for movement in the axial direction of the working ram assembly.

22. A press according to claim 21, wherein said ring nut is engaged by an opposed shoulder of said working ram to provide said stop means.

23. A press according to claim 21, wherein said stop means includes opposed surfaces of said secondary ram and a ring nut threadably engaging a stationery part of said press, said connecting means includes a transverse slot in a lower part of said primary ram and a projection connected to said upper die assembly and which is slidable along said slot, opposed surfaces of said slot and said projection engage to prevent removal of said projection from the slot in said axial direction, an access slot is provided in a lower part of said secondary ram and is arranged to slidably receive said projection during removal and replacement of said die set from and to the press respectively, and said ring nut is adjustable to permit relative axial movement of the two said rams so that the slots thereof may be aligned for the purpose of said removal and replacement.

24. A press according to claim 10, wherein said locking means is mounted on said die set for movement between a stop position and a rest position and is adjustable between an operative condition at which it is held against such movement and an inoperative condition at which it is not so held, and said locking means is engagable with a lower surface of said upper die assembly when that assembly is in either the closed or fully open position of said die set and functions to resist movement of the upper die assembly from the die fully open position when in its stop position and in its operative condition.

25. A press according to claim 24, wherein, when said locking means is in its stop position and operative condition, initial movement of the upper die assembly downwards from the die fully open position causes said locking means to be moved towards the rest position, said locking means will thereafter remain in the rest position until manually moved back to the stop position, and when in said rest position forms part of sensing means for determining whether said die set adopts said closed position.

26. A press according to claim 25, wherein said sensing means includes switch means which operates in response to said upper die assembly adopting a particular relationship with said locking means while that locking means is in said rest position thereof, and control means is responsive to said operation of the switch means to initiate operation of the press whereby the die members of the upper die assembly are moved through their respective working strokes.

27. A press according to claim 1, wherein centering means is provided on said base for engagement with a side of said die set to thereby locate said die set relative to said working ram.

28. A press according to claim 1, wherein said retaining means includes at least one fastening screw which engages with both said die set and said working ram.

29. A press according to claim wherein a waste removal blade is operable to sweep across a surface of said die set upon which waste material may lodge, and drive means is operable to move said bar from one side of said surface to an opposite side thereof and then back again.

30. A press according to claim 29, wherein feed means is operable between operating strokes of said working ram to feed work piece stock through said die set in one direction, said drive means operates to first move said blade in said one direction and then in a reverse direction, and said feed means operates prior to operation of said drive means.

31. A press according to claim 30, wherein a counterforce ram is provided in said base in axial alignment with said working ram and is movable towards and away from said working ram, at least one counterpunch is connected to said counterforce ram for movement therewith and forms part of said die set, and said counterforce ram is operable to cause said counterpunch to eject a work piece from a cavity in said die set surface after said blade has moved in said one direction and before it has moved in said reverse direction.

32. A press according to claim 1, wherein a pair of spaced and substantially parallel side plates extend between said base and a member spaced from said base in the axial direction of said working ram assembly, said base and said member each being interposed between and engaging opposed end portion surfaces of said plates, and each two opposed end portion surfaces are part cylindrical and have the same radius and engage a substantially complementary surface of the base or member respectively.

* * * * *